US009371160B2

(12) United States Patent
Hurst

(10) Patent No.: US 9,371,160 B2
(45) Date of Patent: Jun. 21, 2016

(54) MOVING DEVICE

(75) Inventor: Andrew Hurst, Fyshwick (AU)

(73) Assignee: RAPCO INTERNATIONAL PTY LTD, Fyswick, Australian Capital Territory (AU)

( * ) Notice: Subject to any disclaimer, the term of this patent is extended or adjusted under 35 U.S.C. 154(b) by 998 days.

(21) Appl. No.: 12/503,208

(22) Filed: Jul. 15, 2009

(65) Prior Publication Data

US 2011/0011762 A1 Jan. 20, 2011

(51) Int. Cl.

| | |
|---|---|
| ***B65D 85/00*** | (2006.01) |
| ***B65D 33/25*** | (2006.01) |
| ***B65D 65/08*** | (2006.01) |

(52) U.S. Cl.

CPC ..... *B65D 33/2591* (2013.01); *B65D 65/08* (2013.01); *B65D 2585/647* (2013.01)

(58) Field of Classification Search

CPC ..... A47C 31/10; A47C 31/11; B60N 2/60; B65D 81/03; B65D 2585/647

USPC ..... 206/326, 223, 459.5; 297/250.1

See application file for complete search history.

(56) References Cited

U.S. PATENT DOCUMENTS

| | | | | |
|---|---|---|---|---|
| 5,090,604 | A * | 2/1992 | Howe | 224/641 |
| 5,890,640 | A * | 4/1999 | Thompson | 224/630 |
| 6,024,265 | A * | 2/2000 | Clements | 224/630 |
| 6,189,692 | B1 * | 2/2001 | Campbell, Jr. | 206/326 |
| 6,202,722 | B1 * | 3/2001 | Crocker | 150/154 |
| 6,443,274 | B1 * | 9/2002 | Klamm | 190/18 A |
| 6,901,979 | B1 * | 6/2005 | Herold | 150/159 |
| 7,188,714 | B1 * | 3/2007 | Herold | 190/18 A |
| 2005/0161893 | A2 * | 7/2005 | Darling | 280/30 |
| 2006/0151560 | A1 * | 7/2006 | Chen | 224/645 |
| 2006/0169729 | A1 * | 8/2006 | Reis | 224/154 |
| 2008/0217972 | A1 * | 9/2008 | Foster et al. | 297/250.1 |

* cited by examiner

*Primary Examiner* — Anthony Stashick
*Assistant Examiner* — Ernesto Grano
(74) *Attorney, Agent, or Firm* — Blank Rome, LLP

(57) ABSTRACT

Disclosed herein is a moving device in the form of a bag having an aperture allowing furniture to be placed therein, a closure for the aperture (such as a "hook and loop" fastener, buttons, a zipper, or other suitable device), and at least one tensioning strap to tighten the bag around the furniture. The bag can be made of a flexible and/or waterproof material, and can include additional padding. In some embodiments, the bag can be shaped as a prism, but can also take other shapes. The tensioning strap(s) can extend partially or entirely around the bag, and can be fastened using a hook and loop fastener, bucket or other suitable device. In some embodiments, at least one longitudinal tensioning strap and at least one lateral tensioning strap are provided. The bag can also include one or more handles, one or more transparent viewing windows, and a document pouch.

1 Claim, 3 Drawing Sheets

MOVING DEVICE

FIELD OF INVENTION

This invention relates to a moving device. In particular, the invention relates to a moving device that assists in the moving of furniture from one location to another.

BACKGROUND OF THE INVENTION

Moving house is a task that most people dread. Apart from the distraction to normal life, there is genuine physical effort in moving furniture from one home and placing it into another. There are many physical obstacles that are encountered when moving, such as stairs, doorways and hallways, which require careful manoeuvring of furniture in order to pass by these obstacles. This becomes especially difficult with large items, sofas, tables and beds.

Many items of furniture which need to be moved from a house are relatively fragile. Any bumps or scrapes against doorways, stairs and/or hallways can permanently damage this type of furniture. In order to protect furniture, the furniture is often wrapped in protective material, such as bubble wrap. However, this task is time consuming and often makes the furniture more difficult to handle due to the protective covering being difficult to grasp.

Another problem with moving furniture is that the furniture is often heavy and does not provide handholds at desirable locations. This makes moving of the furniture particularly difficult. Further, it increases the likelihood of the furniture being dropped and damaged. Also, moving this type of furniture increases the likelihood of injury to the person moving the furniture due to inappropriate lifting and carrying techniques required to lift the furniture.

OBJECT OF THE INVENTION

It is an object of the invention to overcome or at least alleviate one or more of the above disadvantages and/or provide the consumer with a useful or commercial choice.

SUMMARY OF THE INVENTION

In one form, although not necessary the only or broadest form, the invention resides in a moving device for moving furniture from one location to another, the moving device comprising:

a bag having an aperture allowing furniture to be placed inside the bag;

a closure to move the aperture between an open position and a closed position; and at least one tensioning strap to tighten the bag around the furniture.

The bag may be varied in size depending upon the specific item of the furniture the bag is designed to encompass. The bag is typically made of flexible material. Preferably, the bag is made from a waterproof material. The bag may be padded with additional padding located in desired locations on the bag, such as corners. The bag may be of any shape but typically is a prism.

The aperture may extend substantially around the bag. The closure may be of any suitable form, such as a "hook and loop" fastener or buttons or other suitable device. However, typically the closure is in the form of a zipper. The zipper may extend substantially along the aperture.

The at least one tensioning straps may extend partially or entirely around the bag. The at least one tensioning strap may be fastened using a hook and loop fastener, bucket or other suitable device. The at least one tensioning strap may include at least one longitudinal tensioning strap and at least one lateral tensioning strap.

A plurality of handles may be located over the bag. The handles may be located on ends and/or sides of the bag.

The at least one transparent viewing window may form part of the bag.

A document pouch may form part of the bag. The document pouch may be transparent.

BRIEF DESCRIPTION OF THE DRAWINGS

An embodiment will now be described, by way of example only, with reference to the accompanying figures in which.

DETAILED DESCRIPTION OF THE PREFERRED EMBODIMENT

Figure 1:
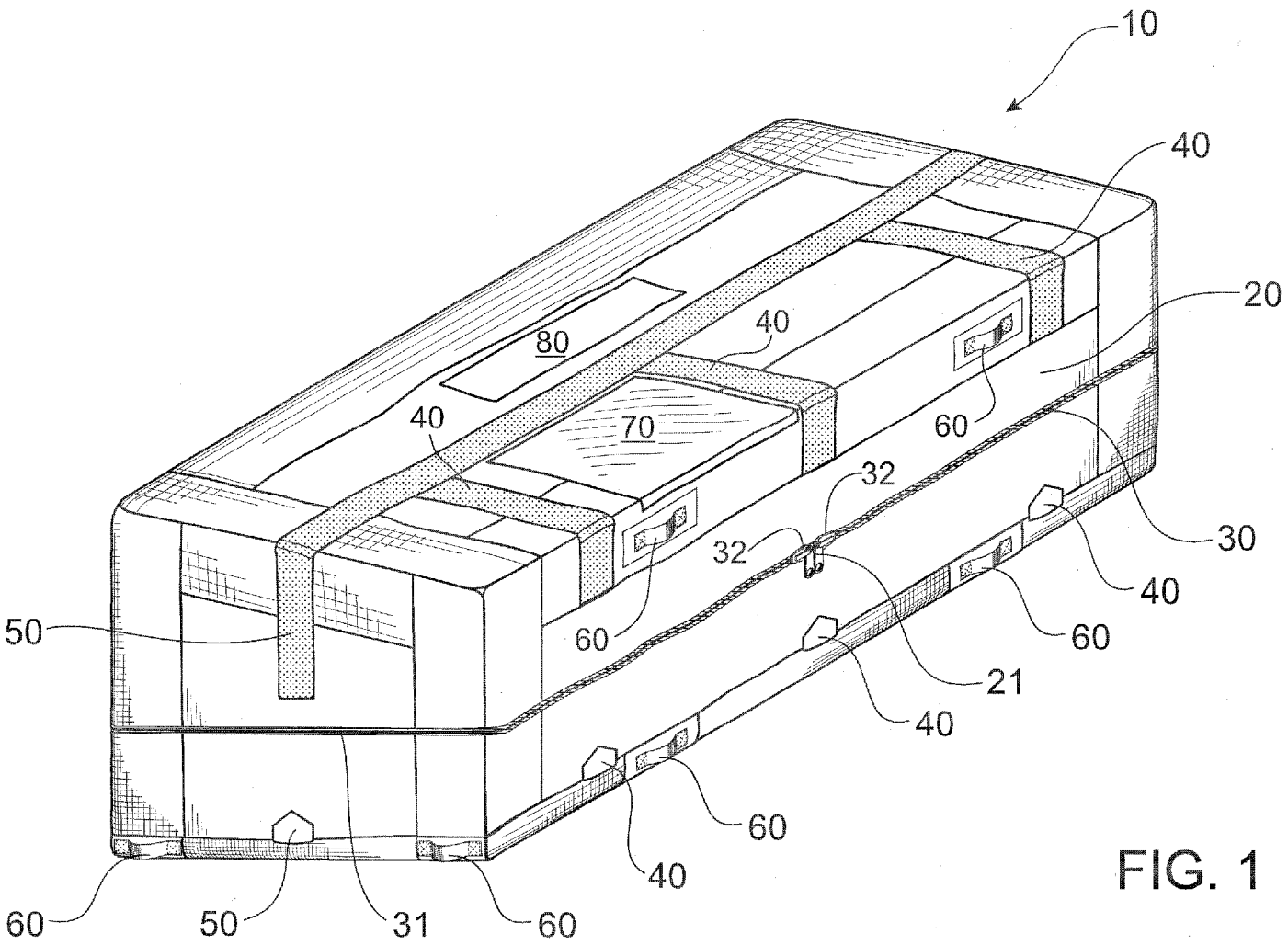
FIG. 1 is a perspective view of a moving device according to an embodiment of the invention.
Figure 2:
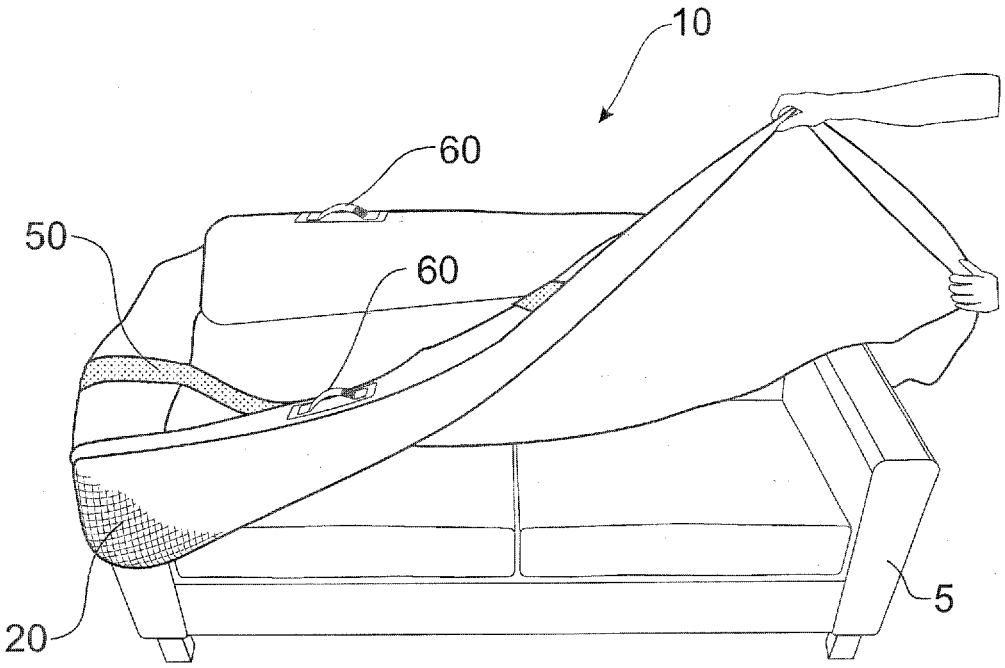
FIG. 2 is the moving device of FIG. 1 being placed over a sofa.
Figure 3:
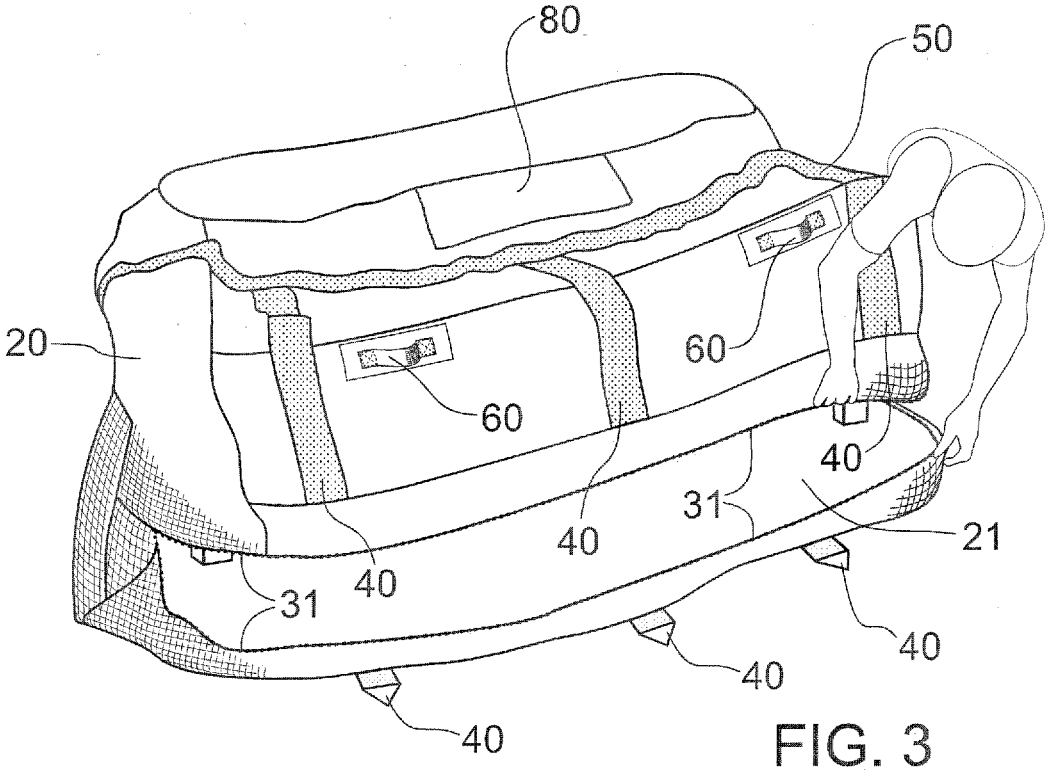
FIG. 3 is a perspective view of the moving device of FIG. 1 being placed under a sofa.

FIG. 1 shows a perspective view of a moving device 10 used to move furniture. The moving device 10 includes a bag 20, a closure 30, three lateral tensioning straps 40 and a longitudinal tensioning strap 50.

The bag 20 is used to enclose the item of furniture that is required to be moved. The bag 20 is made from a water-resistant material, such as nylon or canvas. In this embodiment, the bag 20 is shaped to carry a sofa. However, it should be appreciated that the shape of the bag 20 may be varied depending upon the furniture to be moved.

An aperture 21 extends around the bag 20 so that the bag 20 can be opened to locate a piece of furniture inside the bag 20.

A closure 30 in the form of a zipper 31 extends around the aperture 21. The zipper 31 has two slides 32 to move the zipper 31 between an open position and a closed position.

Three lateral tensioning straps 40 extend around a side of the bag 20 whilst a single longitudinal tensioning strap 50 extends around the ends of the bag 20. Both the longitudinal tensioning strap 50 and lateral tensioning straps 40 can be tightened and released via "hook and loop" fasteners located on the ends of the longitudinal tensioning strap 50 and lateral tensioning straps 40.

Handles 60 are located along the sides and ends of the bag 20. The handles 60 are positioned so that furniture located within the bag 20 can be easily maneuvered regardless of orientation of the furniture.

Padding (not shown) is located inside the bag 20 with additional padding (not shown) being located in the corners of the bag 20. Padding (not shown) is normally in the form of felt. However, other types of padding may be used, such as bubble wrap or foam.

A viewing window 70 is located in the top and base of the bag 20. The viewing window 70 allows identification of the furniture located inside the bag 20 without the need for aperture the bag 20 via the closure 30.

A transparent document pouch 80 is provided on the bag 20 for location of documents which may include identification of what is inside the bag 20.

Figure 4:
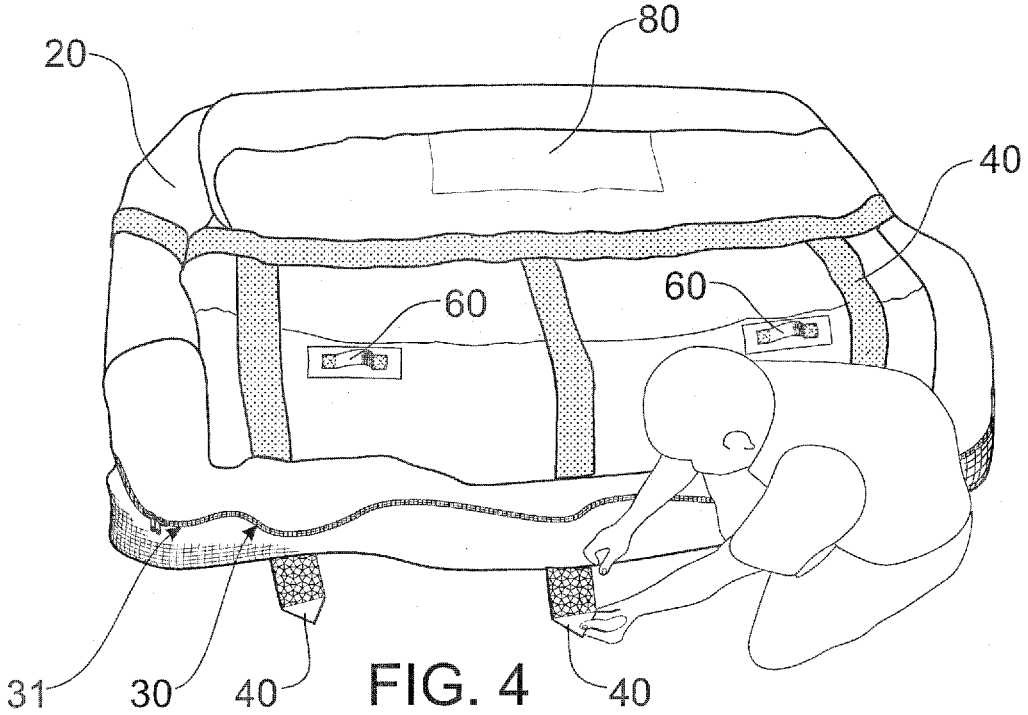
FIG. 4 is a perspective view of the moving device of FIG. 1 in which the tensioning straps are being fastened.
Figure 5:
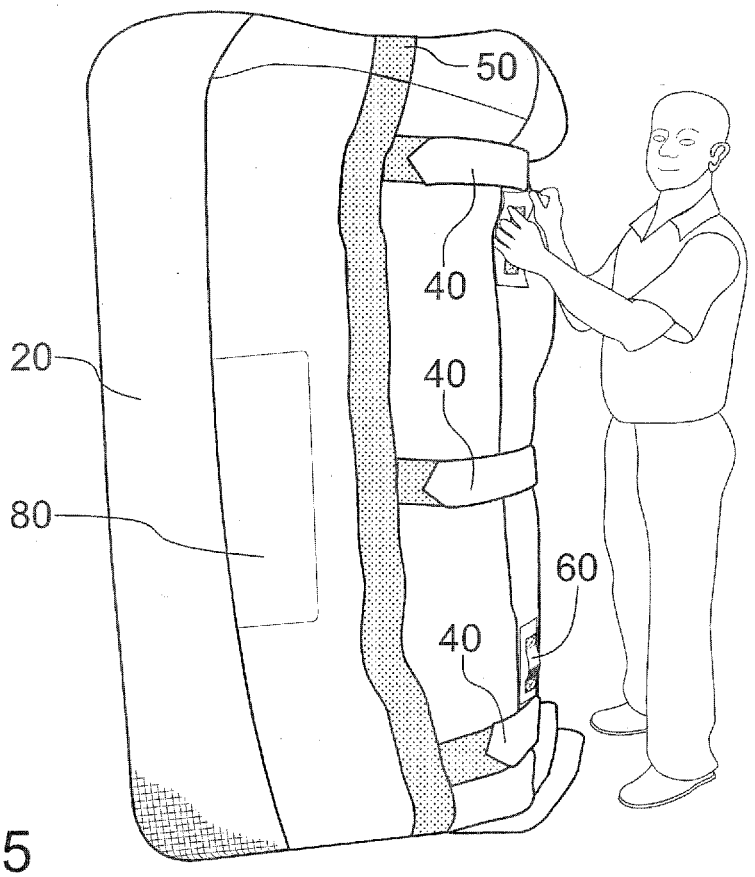
FIG. 5 is a perspective view of the moving device of FIG. 1 being used to move a sofa.

FIGS. 2 to 5 show the moving device 10 being used to move a sofa 5. In use, the slider 32 of the zipper 31 is used to open the aperture 21 of the bag 20 in order to allow the sofa 5 to be placed through the aperture 21 and into the bag 20. Once the closure 30 is opened, a top of the bag 20 is placed over the sofa 5. The sofa 5 is then lifted to allow a bottom of the bag 20 to be located under the sofa 5 as shown in FIG. 4. The closure 30 is closed (i.e. the zipper 31 is closed).

Once the closure 30 is closed, the lateral tensioning straps 40 and longitudinal tensioning strap 50 are tightened by pulling one end of the lateral tensioning straps 40 and longitudinal tensioning strap 50 and then fastening it to the other end of the lateral tensioning straps 40 and longitudinal tensioning strap 50 via the "hook and loop" fasteners. An identification document can then be placed in the document pouch 80 to identify the item of furniture. Further, the furniture can be identified using the viewing window 70. The furniture can then easily be carried by the handles 60 and maneuvered depending on any obstacles that are encountered, such as doors, stairs or hallways.

The moving device 10 provides a quick and simple method of moving furniture. The furniture is protected at all times from incidental scrapes. Further, the furniture can be quickly and easily moved by the handles 60. Furniture identification becomes simple by using the viewing window 70 and/or document pouch 80.

It will also be appreciated that various other changes and modifications may be made to the embodiment described without departing from the spirit and scope of the invention.

The invention claimed is:

1. A moving device for moving furniture from one location to another, the moving device comprising:

a bag having an aperture allowing furniture to be placed inside the bag;

a closure to move the aperture between an open position and a closed position; and at least one longitudinal tensioning strap and at least one lateral tensioning strap, wherein the tensioning straps have fasteners that tighten and release the straps and the bag around the furniture;

wherein the bag is padded and wherein additional padding is located in one or more corners of the bag.

* * * * *